US011497302B2

(12) United States Patent
Meidl et al.

(10) Patent No.: US 11,497,302 B2
(45) Date of Patent: Nov. 15, 2022

(54) BRUSH HEAD MANUFACTURING METHOD AND DEVICE

(71) Applicant: KONINKLIJKE PHILIPS N.V., Eindhoven (NL)

(72) Inventors: Michael Meidl, Klagenfurt (AT); Martin Varch, Klagenfurt (AT)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 202 days.

(21) Appl. No.: 16/757,266

(22) PCT Filed: Sep. 26, 2018

(86) PCT No.: PCT/EP2018/076041
§ 371 (c)(1),
(2) Date: Apr. 17, 2020

(87) PCT Pub. No.: WO2019/081146
PCT Pub. Date: May 2, 2019

(65) Prior Publication Data

US 2021/0186204 A1 Jun. 24, 2021

Related U.S. Application Data

(60) Provisional application No. 62/576,154, filed on Oct. 24, 2017.

(51) Int. Cl.
*A46D 3/04* (2006.01)

(52) U.S. Cl.
CPC ..... *A46D 3/045* (2013.01); *A46D 3/047* (2013.01); *A46B 2200/1066* (2013.01)

(58) Field of Classification Search
CPC .. A46B 3/00; A46B 2200/1066; A46D 3/047; A46D 3/3045
USPC ..... 300/21, 8
See application file for complete search history.

(56) References Cited

U.S. PATENT DOCUMENTS 2,647,019 A * 7/1953 Maynard ..... A46D 3/06 15/186
2,778,689 A * 1/1957 Evans ..... A46D 3/04 211/65

(Continued)

FOREIGN PATENT DOCUMENTS

DE 4041849 A1 6/1992
DE 10221786 A1 11/2003

(Continued)

OTHER PUBLICATIONS

Translation of DE102005024082A1, retrieved from Espacenet on Feb. 16, 2022 (Year: 2006).*

(Continued)

*Primary Examiner* — Orlando E Aviles
*Assistant Examiner* — Thomas Raymond Rodgers

(57) ABSTRACT

A method (500) for manufacturing a brush head (10). The method includes the steps of providing a plurality of bristle tuft retention elements (52), and inserting a bristle tuft (21) into each of the bristle tuft retention elements; using a heat reflection device (200) to evenly apply heat to at least partially melt the bristle tuft proximal end and, optionally, the retention element, create proximal end head portion (26) to retain the bristle tuft in the retention element.

10 Claims, 7 Drawing Sheets

(56) References Cited

U.S. PATENT DOCUMENTS

| | | | | |
|---|---|---|---|---|
| 4,637,660 | A | 1/1987 | Weihrauch | |
| 5,344,218 | A | 9/1994 | Weihrauch | |
| 5,970,564 | A | 10/1999 | Inns | |
| 6,991,967 | B2 | 1/2006 | Liu et al. | |
| 8,069,524 | B2 | 12/2011 | Kraemer | |
| 9,636,898 | B2 | 5/2017 | Ganninger et al. | |
| 2001/0038237 | A1 | 11/2001 | Boucherie | |
| 2010/0299859 | A1 | 12/2010 | Kastl | |
| 2012/0317738 | A1 | 12/2012 | Birk | |
| 2013/0326834 | A1 | 12/2013 | Vankov et al. | |
| 2014/0075696 | A1 | 3/2014 | Pfenniger et al. | |
| 2014/0232173 | A1* | 8/2014 | Birk | B29C 66/8322 300/21 |
| 2015/0000064 | A1 | 1/2015 | Moskovich et al. | |

FOREIGN PATENT DOCUMENTS

| | | | | | |
|---|---|---|---|---|---|
| DE | 20301634 | U1 | | 6/2004 | |
| DE | 102005024082 | A1 | * | 11/2006 | A46B 15/0075 |
| EP | 1603429 | B1 | | 8/2007 | |
| EP | 2078472 | B1 | | 2/2010 | |
| EP | 2534973 | A2 | | 12/2012 | |
| EP | 2674061 | A1 | | 12/2013 | |
| EP | 2727493 | A1 | | 5/2014 | |
| WO | 2013186674 | A1 | | 12/2013 | |

OTHER PUBLICATIONS

International Search Report and Written Opinion, International Application No. PCT/EP2018/076041, dated Jan. 11, 2019.

* cited by examiner

BRUSH HEAD MANUFACTURING METHOD AND DEVICE

This application is the U.S. National Phase application under 35 U.S.C. § 371 of International Application No. PCT/EP2018/076041, filed on 26 Sep. 2018, which claims the benefit of U.S. Provisional Application No. 62/576,154, filed 24 Oct. 2017. These applications are hereby incorporated by reference herein.

FIELD OF THE INVENTION

The present disclosure is directed generally to methods for manufacturing a brush head assembly with bristle tufts retained within an elastomeric matrix.

BACKGROUND

The brush heads of both manual and power toothbrushes comprise bristles which are used to clean the teeth, tongue, and cheeks. In some toothbrushes, the bristles are stapled, or anchored, into the neck portion of the brush head. In other toothbrushes, the bristles are secured to the head without staples, in methods commonly known as "anchor free tufting". In some toothbrushes, the bristles are organized into bristle tufts contained within retention or carrier elements. The retention elements serve to secure the bristle tufts within the brush head. During manufacture, the bristle tufts are inserted into the hollow interior of the retention element, and the proximal portion of the bristles are melted together using a hot knife or heating plate or hot air to form a proximal end head portion to secure the bristles in the retention elements, which are then secured into an elastomeric material, along with the brush neck, and the elastomeric material is then allowed to cool in order to form the final brush head.

Often, however, the hot knife or heating plate or hot air does not heat evenly, and so individual bristles or the entire mushroom head are not secured firmly within the retention elements, and can come loose within the brush head, or the bristles might not always be positioned at an angle optimal for brushing. As such, under the dynamic conditions of motion induced by the power toothbrush operation, for example, the bristles or bristle tufts may separate from the brush head.

Accordingly, there is a need in the art for a method and apparatus for more effectively and efficiently heating the bristle tuft ends to achieve a more uniform melting and improved bonding of the bristles to each other, and in some arrangements, also to the retention elements.

SUMMARY OF THE INVENTION

The present disclosure is directed to inventive methods for manufacturing a brush head with bristle tufts in retention elements. Various embodiments and implementations herein are directed to manufacturing methods using a more efficient and effective method of heating, in the step in which bristle tufts are melted together to form a head at the proximal end thereof, or in which the bristle tufts and retention elements are melted to secure the bristle tufts and retention elements together. The resulting components, along with a brush head neck, are then embedded within an elastomeric matrix, resulting in a completed brush head. Using the various embodiments and implementations herein, cost-effective and efficient production of brush heads is substantially improved.

For example, in some embodiments, the manufacturing method includes inserting a tuft of bristles into a retention element or tool plate and then using a heat reflection method to melt the proximal end of the bristle tufts to form a proximal end head portion that does not come back through the retention element or tool plate, or by melting a proximal end of the bristle tuft and a portion of the proximal side of the retention element or tool plate using a heat reflection method that more uniformly heats the bristle tufts to cause a more consistent melting. This can minimize movement of the bristle tuft during use, or allow only certain movements of the bristle tuft during use of the brush head. The brush heads disclosed and described herein can be used with any manual or power toothbrush device. Thereafter, the melted bristle tufts can be over-molded with at least one elastomeric matrix and/or other neck materials In one aspect, a method for manufacturing a brush head is provided. The method includes the steps of: inserting a proximal end of at least one bristle tuft into an opening of at least one tool plate or tuft carrier having, the tool plate or tuft carrier having at least one bristle tuft retention element; activating a heat reflection device having at least one heating element and at least one heat reflecting surface therein; placing the at least one bristle tuft retention element with the inserted bristle tuft into a heat reflection device having at least one heating element and at least one heat reflecting surface; directing heat from the at least one heating element toward the at least one bristle tuft retention element with the inserted at least one bristle tuft to at least partially melt the at least one bristle tuft proximal end to create a proximal end head portion; and cooling the melted proximal end head portion.

In an embodiment, the method further includes the step of placing a platen portion of a brush head neck in relation to the proximal end head portion wherein the positioning of the platen portion of the neck defines a space in relation to the proximal end head portion for injection of an elastomeric material, and injecting the elastomeric material into the space to create an elastomeric matrix that at least partially encompasses the platen neck and the proximal end head portion.

In an embodiment, the retention element and bristle tufts are made of a same material or similar material having a similar melting temperature such that the melting of the placing step partially melts and merges the bristle tuft proximal end and at least a portion of a proximal side of the retention element together to create the proximal end head portion.

In an embodiment, the heating element or the at least one heat reflecting surface is at least partially adjustable, i.e., in distance from and angle relative to the tool plate or retention element within the heat reflection device to direct the heat.

In an embodiment, the heating element is a hot air heat source. Alternatively, the heat source may be an electric driven helical heating element, or any other heating element which provides a sufficiently high temperature to melt the bristle tufts.

In an embodiment, the temperature of the heat generated by the heating element is controllable and adjustable.

In an embodiment, the heat reflection device has multiple sides to at least partially contain the heat generated by the heating element.

In an embodiment, the heat reflection device further has at least one opening that can be used to insert or remove the at least one bristle tuft retention element or tool plate with the inserted bristle tuft in the heat reflection device to help further contain the heat generated by the heating element in the heat reflection device.

In an embodiment, the heat reflection device further has at least one door that can be used in the at least one opening that can be opened to insert or remove the at least one bristle tuft retention element with the inserted bristle tuft in the heat reflection device to help further contain the heat generated by the heating element in the heat reflection device.

In an embodiment, the step of placing the at least one bristle tuft retention element within the heat reflection device is performed by a transport mechanism arranged to move a tool plate arranged to hold the at least one bristle tuft retention element from outside the heat reflection device to inside the heat reflection device.

In an embodiment, the step of cooling the melted proximal end head portion is accomplished by moving the tool plate arranged to hold the at least one bristle tuft retention element from inside the heat reflection device to outside the heat reflection device.

In another aspect, a heat reflection device for melting a bristle tuft proximal end is provided. The device includes: at least one heating element; at least one heat reflecting surface for reflecting heat from the at least one heating element toward a tooling plate used to contain bristle tufts and at least one retention element used in a brush head; and wherein the heat from the at least one heating element and reflected heat from the at least one heat reflecting surface are directed toward the tooling plate to at least partially melt a proximal end of the bristle tuft to create a proximal end head portion to secure the bristle tuft in the retention element.

In an embodiment, the device further includes a transport mechanism for moving the tool plate into and out of the heat reflection device. It should be appreciated that by "into and out of" with respect to the movement of the tool plate, it is contemplated that this can include an embodiment where the tool plate moves into the heat reflecting device through a first opening, heat is applied, and then the tool plate is moved from inside the device to outside the device through the first opening. It should further be appreciated that it is contemplated that this can include an embodiment where the tool plate moves into the heat reflecting device through a first opening, heat is applied, and then the tool plate is moved from inside the deice to outside the device through a second opening arranged elsewhere on the device, e.g., on an opposing side of the device as the first opening.

In an embodiment, the device further includes: a first side wall having a first heat reflecting surface; a second side wall having a second heat reflecting surface; a top wall arranged between the first side wall and the second side wall, the top wall having a third heat reflecting surface; and, at least one opening arranged between the first side wall and the second sidewall, wherein the at least one opening is operatively arranged to receive the tooling plate.

In an embodiment, the at least one opening comprises a door-like device.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. These and other aspects of the invention will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF EMBODIMENTS

The present disclosure describes various embodiments of a method for manufacturing a brush head assembly which provides a more even and consistent heat during the step of melting the proximal ends of the bristle tufts, or the proximal end of the bristle tufts and proximal side of the retention elements together. More specifically, applicants have recognized and appreciated that it would be beneficial to provide a method of manufacturing a brush head that has an improved method of applying heat so that more consistent melting of the proximal ends of the bristle tufts, or the proximal end of the bristle tufts and proximal side of the retention elements is achieved for better products. By performing the heating step in a contained area that reflects heat back toward the area being heated, a more consistent melting temperature is achieved across the surface(s) being heated, resulting in a more uniform melting. Additionally, less heat loss is experienced, and in some cases the energy needed to operate the heating mechanism can be reduced. A particular goal of utilization of certain embodiments of the present disclosure is the ability to efficiently manufacture brush heads with improved retention of the bristle tuft or bristle tuft and retention element in the brush head.

Figure 1A:
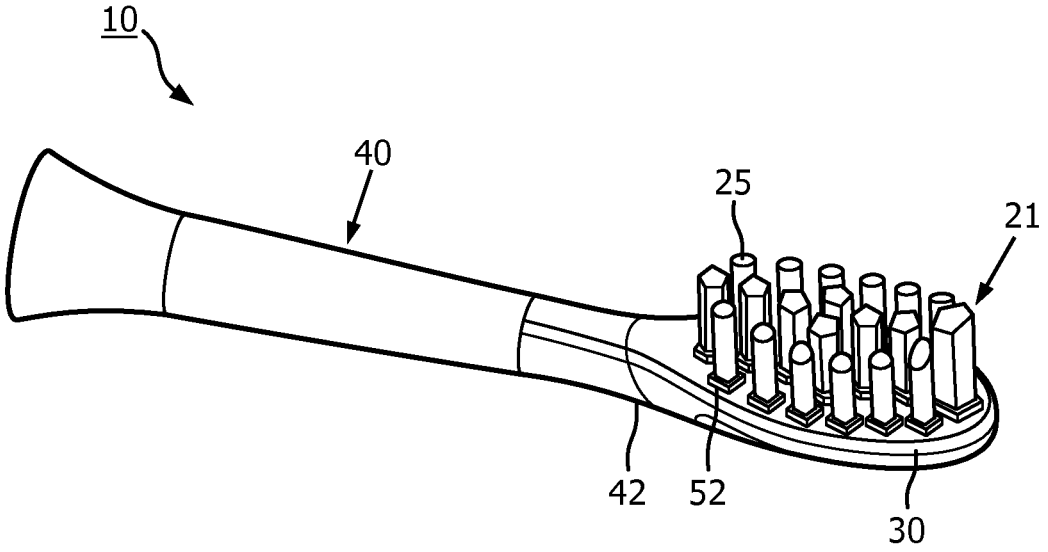
FIG. 1A is a perspective schematic representation of a brush head assembly in accordance with an embodiment of the present invention.
Figure 1B:
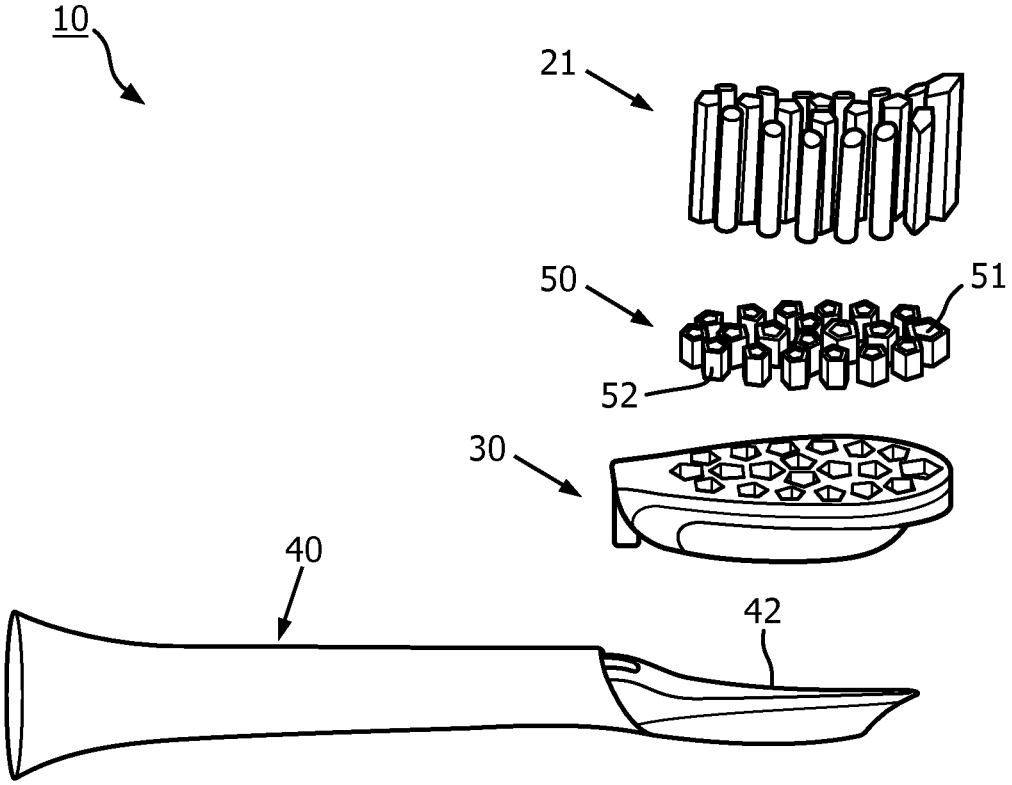
FIG. 1B is a perspective exploded view of a brush head assembly in accordance with an embodiment of the present invention.

FIG. 1A is a schematic representation of a brush head assembly 10 of the present invention manufactured with anchor-free tufting. FIG. 1B is a perspective exploded view of brush head assembly 10 of the present invention with anchor-free tufting. The brush head 10 includes a neck 40, which can be coupled to any manual brush shaft, or, more preferably, to any actuator and drive shaft (not shown) made or suitable for oral care brushes, or other brushing or cleaning devices now known or to be developed. The brush head also includes a plurality of bristle tufts 21, retained within an opening 51 in tuft carrier 50. Tuft carrier 50 includes one or more retention elements 52. A portion of the retention elements 52 containing the bristle tufts, along with the at least a portion of the neck 40 that is the platen 42 are subsequently encapsulated within a flexible elastomeric matrix 30 to form a head portion of the brush head assembly 10 as shown in FIG. 1A.

Figure 2:
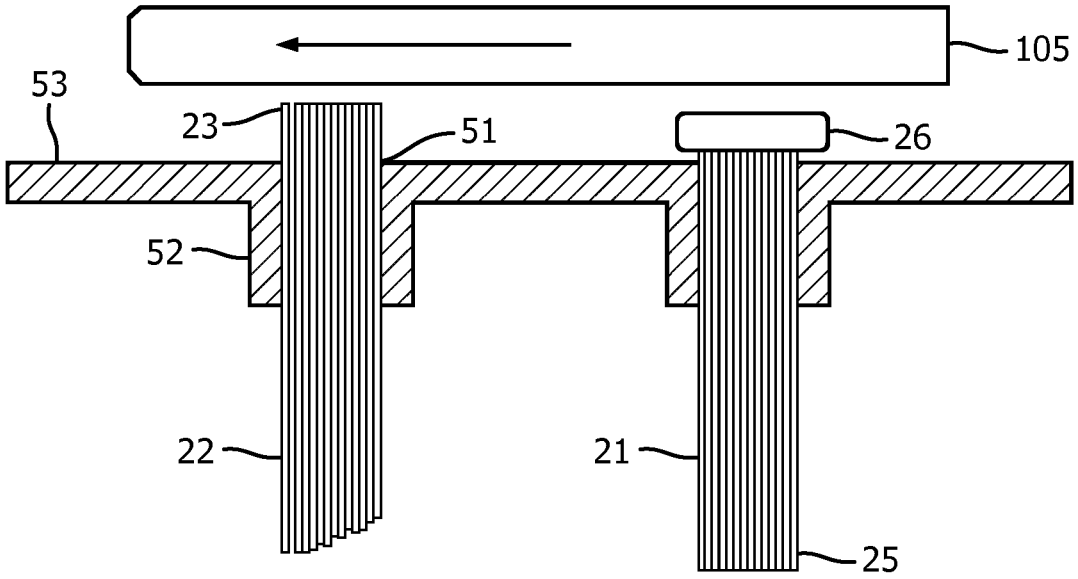
FIG. 2 (Prior art)
FIG. 2 is a cut-away side view schematic representation of melting of brush head components in accordance with the prior art.

Each bristle tuft 21 is comprised of a plurality of bristle strands 22, and each bristle tuft 21 has a proximal end 23 and a free end 25, as shown in FIG. 2, where the proximal end 23 of each bristle tuft is inserted into an opening 51 in a retention element 52. Bristle tufts 21 can be of varying shapes and sizes, as can be seen in FIGS. 1A and 1B. The bristle tufts 21 can be formed to a shape and diameter to match the openings 51 in the retention element 52 into which they will be inserted. Retention elements 52 and the openings 51 therein can be of the same size, shape and arrangement, such as round, triangular, square, pentagonal, hexagonal, heptagonal, octagonal, nonagonal, decagonal or other shape, some of which are seen in FIG. 1, or can vary from one another. The tuft carrier 50 can be configured to hold a single bristle tuft 21, or the tuft carrier 50 can comprise a plurality of retention elements 52 having openings 51 connected to each other in some method, as shown in FIG. 2.

As shown in FIG. 2, in the prior art, once the bristle tufts 21 are inserted into the retention element 52, heat is applied to the proximal end 23 of the plurality of bristle tufts 21 to create a proximal end head portion 26. Proximal end head portion 26 is formed by the melted proximal end 23 of the bristle tuft 21, or the melted proximal end 23 of the bristle tuft 21 and the melted proximal side 53 of at least a portion of the tuft carrier 50. The heat is supplied by a heating element 105, such as a hot knife that is either placed in direct physical contact with the proximal end of the bristle tufts, or as shown in FIG. 2, moves across the proximal side 53 of the retention elements 52 containing the proximal end 23 of the bristle tufts 21 so as to achieve sufficient heat to melt the proximal end 23 of the bristle tuft 21, or melt the proximal end 23 of the bristle tuft 21 and a portion of the proximal side 53 of the tuft carrier 50 together, and create the proximal end head portion 26. In other arrangements of the prior art, hot air or another form of heat source (not shown) can be the heating element used to supply the heat, with heated air being directed down onto or across the area to be melted.

Figure 3A:
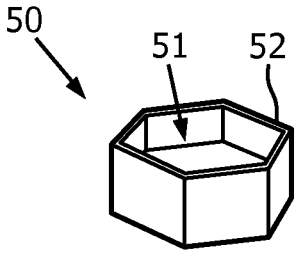
FIGS. 3A-3F are schematic representations of tuft carriers according to different embodiments disclosed herein.
Figure 3B:
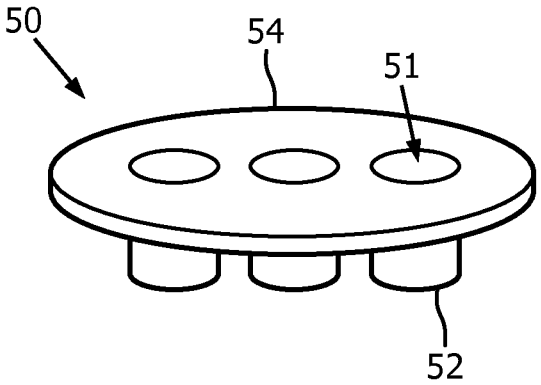
Figure 3C:
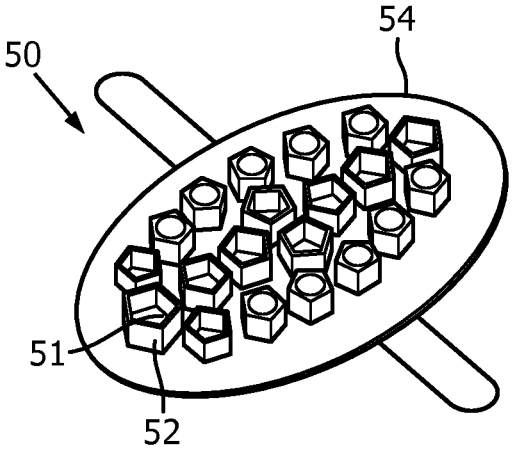
Figure 3D:
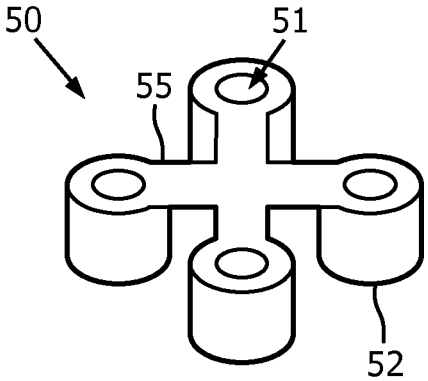
Figure 3E:
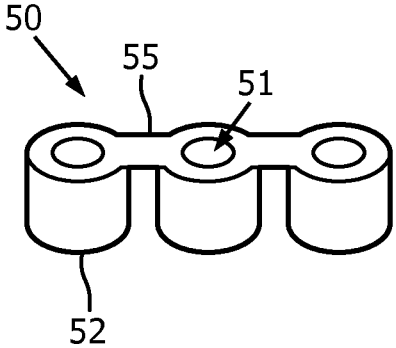
Figure 3F:
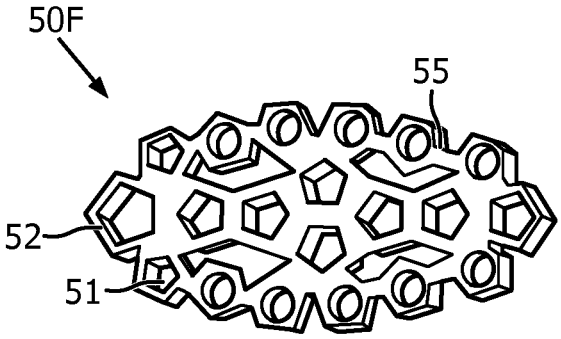

As shown in FIGS. 3A-3F various tuft carriers 50 can be utilized in the different embodiments of the present invention as disclosed herein. A tuft carrier 50 in FIG. 3A comprises a single one of the retention elements 52, which will hold a single one of the bristle tufts 21. FIGS. 3B and 3C respectively show that tuft carrier 50 can comprise a carrier plate 54 having a plurality of the retention elements 52 connected together, e.g., arranged in a shape of the final brush head or some portion thereof. In FIGS. 3D-3F, tuft carriers 50 comprise a tuft carrier web that has a plurality of individual retention elements 52 connected to each other by a series of strands or webbing links 55. In this way, it is to be appreciated that the retention elements 52 can be separate discrete units, or interconnected together, such as by the carrier plate 54 or the webbing links 55. Similar to the tuft carriers shown in FIGS. 3B and 3C, the retention elements 52 and/or the openings 51 of the tuft carriers shown in FIGS. 3D-3F may be arranged in the desired pattern for the tufts 21 when the brush head is fully assembled, or some portion thereof. It can be appreciated that a variety of other configurations and arrangements of tuft holding mechanisms where at least a portion of the bristle tufts are melted to hold the tuft in the holding mechanism can also be used in conjunction with the present invention, Typically, a series of manufacturing steps are used to create a brush head where: (a) retention elements are made; (b) bristle tufts are inserted into the retention elements; (c) the proximal side of the retention elements and/or bristle tufts are melted to secure the bristle tufts in the retention elements; (d) the retention elements with bristle tufts secured therein and a brush head neck are positioned in the desired position; and (e) an elastomeric matrix is injected around a portion of the neck and retention elements containing bristles to encapsulate and join all the parts together. Step (c) is the step to which this invention pertains. Because there are a series of manufacturing steps, the components are typically held on a tooling plate 400, to which components are added or removed, or treated. In many manufacturing processes, a single tooling plate 400 is used throughout the steps in the manufacturing process so components can be held and processed, or moved to subsequent processing steps if they occur in different manufacturing equipment. Two example embodiments of tool plate 400 are shown in FIGS. 4A-5B and discussed below.

Figure 4A:
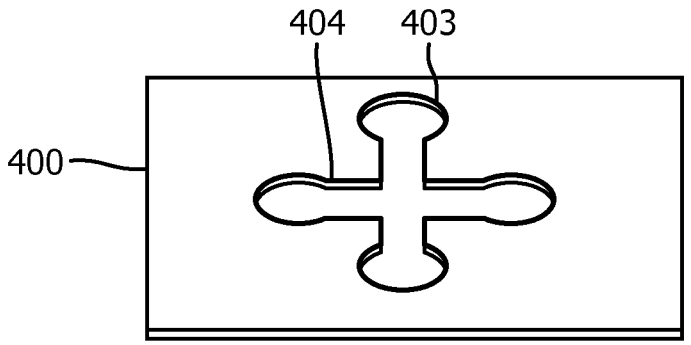
FIGS. 4A-4B illustrate a tool plate and the tool plate engaged with a tuft carrier according to one embodiment of the invention.
Figure 4B:
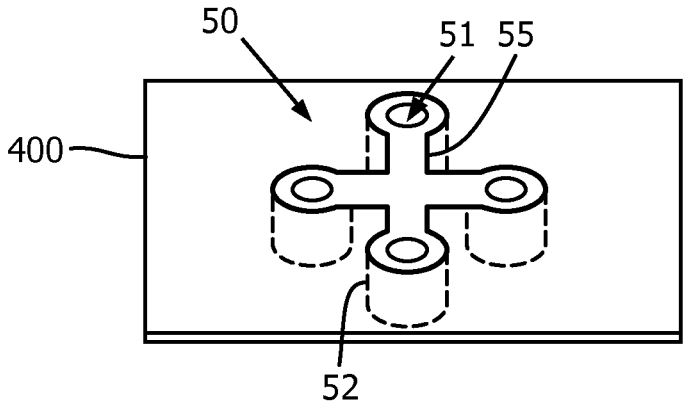

To facilitate handling of the tuft carriers 50, a tool plate 400 may be used. As shown in FIGS. 4A and 4B, tool plate 400 includes openings 403, which correspond in shape, size, and layout to the retention elements 52 of the tuft carrier 50 shown in FIG. 3D. For example, the openings 403 can be aligned with, or form, the openings 403 in a die block to facilitate stamping of the tuft carrier 50 from the tool plate 400 directly into the die block, or positioning of the tuft carrier or tuft carrier in the tool plate in other manufacturing equipment.

Additionally, the tool plate 400 may include a set of grooves or recesses 404, which are shaped and sized to receive the webbing links 55 of the tuft carrier 50 shown in FIG. 3D. In this way, for example, the grooves may assist in positioning and holding the tuft carrier 50 during stamping. The webbing links 55 of tuft carrier 50 may form the excess material that is discarded after stamping the tuft carrier 50 with the tool plate 400, or they may remain attached to the retention elements 52 throughout the manufacturing process. It is noted that the tool plates 400 disclosed and envisioned herein may be removably separated from the die block or other base plate or mold, e.g., to facilitate further processing of the corresponding tuft carrier conveyed by the tool plate. In this way, the tool plate 400, together with the webbing links 55 left behind in the grooves 404, may be separated from the die block after stamping if desired.

Figure 5A:
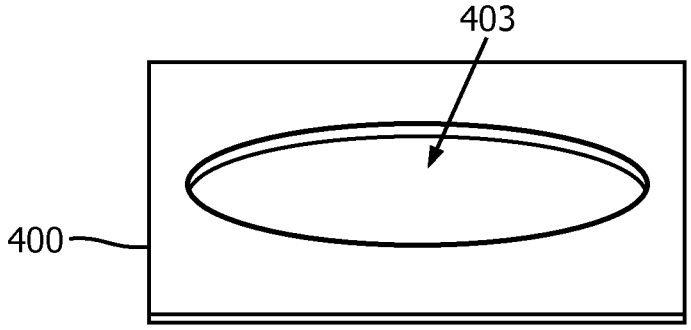
FIGS. 5A-5B illustrate a tool plate and the tool plate engaged with a tuft carrier according to one embodiment of the present invention.
Figure 5B:
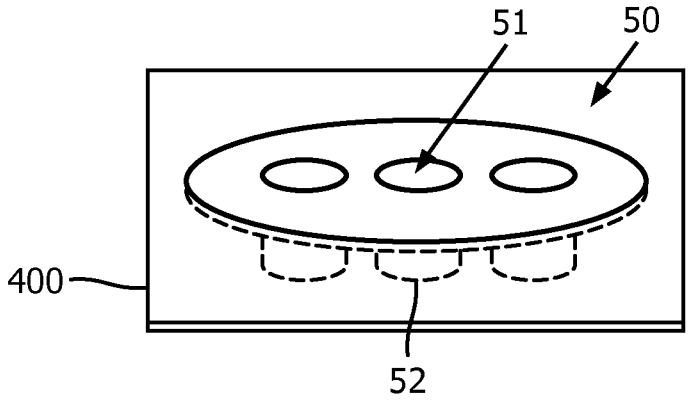

A tool plate 400 according to another example embodiment of the present invention is illustrated in FIGS. 5A-5B. Unlike the tool plate illustrated in FIGS. 4A-4B, the tool plate 400 illustrated in FIGS. 5A-5B includes an opening 403, which corresponds in general shape, size, and/or layout to the carrier plate 54 of the tuft carrier 50 of FIG. 3B (as opposed to the individual retention elements 52). In this way, some or all the carrier plate 54 may remain with the retention elements 52 for various manufacturing steps, e.g., in the die block after stamping, and/or may be included in the brush head 10 during final assembly. For example, instead of stamping, the tool plate 400 may be utilized to facilitate the general handling of the tuft carrier 50 and/or the loading of the tuft carrier 50 into other tools, such as a tufting unit. In one embodiment, a stamping tool may be configured, with a punch or stamping element to remove only a portion of the carrier plate 54 so as to change the shape of tuft carrier 50 of FIG. 3B to the shape of the tuft carrier 50 of FIG. 3E. In other words, excess portions of the carrier plate 54 may be removed to leave behind only the webbing links 55. In other embodiments, the carrier plate 54 may be utilized without removing any excess portions.

Figure 6:
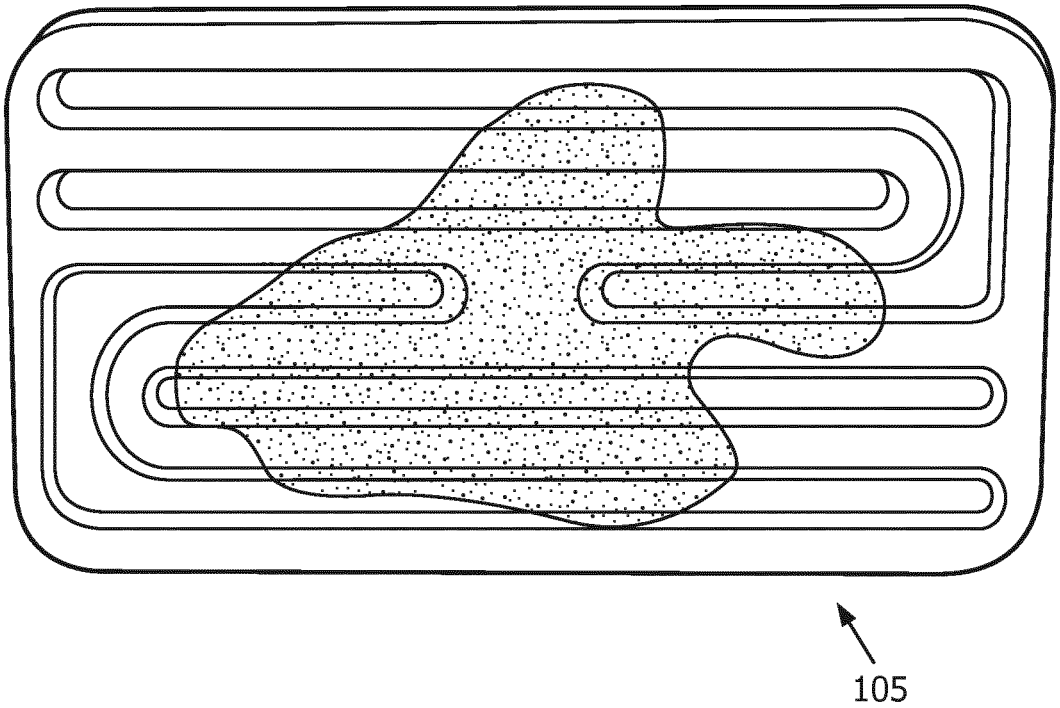
FIG. 6 is a front view of an arrangement of a heating element used for melting brush head components.

As shown in FIG. 6, the heating elements 105 used in these processes often have uneven temperatures at the heating surfaces, resulting in hot and cold spots, so heat is not applied consistently to the melting area or to different components in different positions in the heating area. Similarly, hot air can be subject to inconsistent application of heat due to air currents or air circulation in the manufacturing area, or greater concentration of heat in a central area, with heat dissipating further from the heat source. When heat is not applied evenly, it can result in some area of the bristles 22 melting unevenly, either too much, leading to burning, or too little, leading to bristles 22 or bristle tufts 21 not being retained in the retention elements 52, and possibly coming loose during use of the brush.

To address these issues, the present invention comprises a heat reflection device 200, that uses one or several heating elements 105 arranged in a line or other pattern, placed at an optimal distance from the surface(s) to be melted. In one example embodiment of the present invention four heating elements 105 are provided in series within heat reflection device 200. In another example embodiment of the present invention, four heating elements 105 are provided in a two-by-two square grid arrangement within the heat reflecting device 100. The heating elements 105 are surrounded, or partially surrounded by heat reflective surfaces 210, made of a heat-resistant material, to focus or reflect heat from the heating elements 105, toward the surface(s) being melted so that a more uniform heat is applied and a more consistent melting is achieved. According to one example embodiment of the present invention heat reflection device 200 can form the shape of an elongated rectangular housing having at least three connected and contiguous sides where each side comprises a heat reflective surface 210. However, it should be appreciated that, depending on the embodiment of the present invention, the heat reflective surfaces 210 need only be used on one or more sides of the interior of the heat reflection device 200, such as the surface directly behind the heating elements, the surface beneath the materials to be processed, or surfaces to the sides of the materials to be processed. Additionally, in some arrangements of the present invention, the heating elements 105 have a variable temperature setting so that the heating elements can be adjusted to reflect the appropriate melting temperature of the materials used to make the bristle tufts 21 and retention elements 52, or other variable aspects of the manufacturing process. In some arrangements of the present invention, the heating elements 105 can be moved, or adjusted, so that an optimal distance from the surfaces(s) to be melted can be obtained, depending on the materials being melted and/or the speed of the manufacturing process. In some arrangements of the present invention, the temperature of the heating elements 105 ranges between 600 and 1000 degrees C., with a preferred range between 750 and 850 degrees C.; however, it should be appreciated that other temperatures may be used dependent on the distance between the heating elements 105 and tuft carrier 52, and the materials being melted. Further, in some arrangements of the present invention, the heat reflective surfaces 210 are at least partially movable/adjustable so the reflected heat can be directed at a particular area or areas, depending on the particular components being melted.

Figure 7:
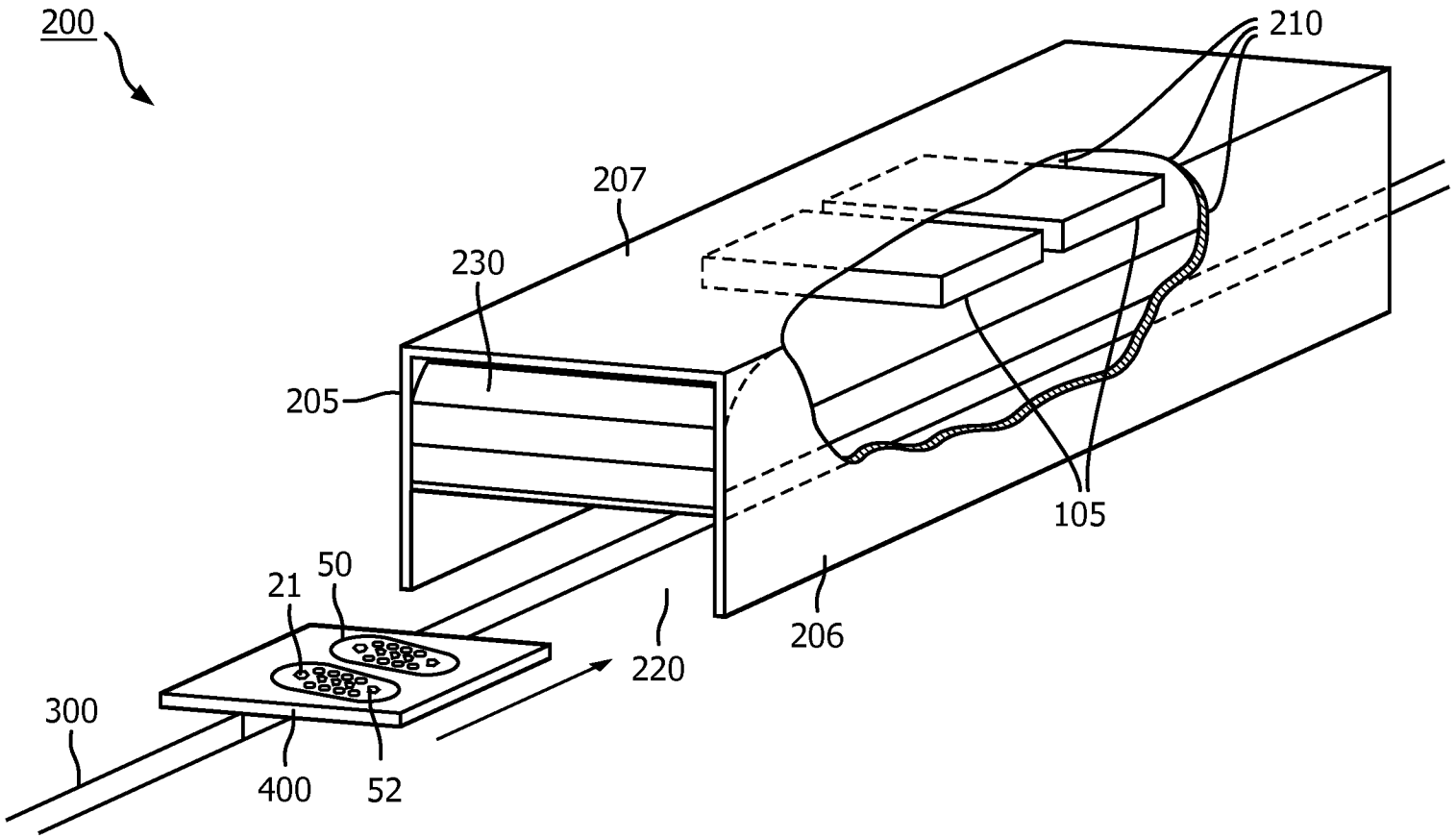
FIG. 7 is a representation of a heat reflection device of the present invention.

In one arrangement, as shown in FIG. 7, the heat reflection device 200 resembles an elongated rectangular housing or a tunnel, having at least two side walls including a first side wall 205, a second side wall 206, one top wall 207, and optionally a bottom wall (not shown) at least one of which is made of or covered with heat reflective surfaces 210, and with an opening 220 on the front side and optionally at the rear side (not shown). Additionally, in some arrangements of the present invention, one or both openings 220, can be further enclosed by a door like device 230, which can be opened and closed to allow entry and exit of the tuft carrier 50 containing the retention elements 52 and bristle tufts 21 for the heating portion of the manufacturing process. The door-like devices 230 shown in FIG. 7 are roll-up type sectioned devices, similar to known garage doors. However, it can be appreciated that many door styles could be used, such as ones that are single-units hinged on side(s) or top, standard entry doors into homes or single-section garage doors, or doors hinged on both sides that open in the middle, or a variety of other arrangements. Additionally, in some arrangement of the present invention, a door having only an opening of the size necessary to allow processed materials to enter and exit is used; this type of door-like device does not necessarily open and close. The purpose of these door-like devices 230 is to help retain heat within the heat reflection device 200 by remaining closed when materials are being processed, and opening to allow materials being processed to enter or exit, or if necessary to reduce temperature in the heat reflection device.

In one embodiment of the manufacturing process, as depicted in FIG. 7, the tooling plate 400 is mounted on a transport system 300, which transports the tool plate 400 with the tuft carrier 50 having retention elements 52 and bristle tufts 21 from a previous manufacturing step, where the bristle tufts 21 were inserted into the retention elements 52, or other processing occurred, to and through the heat reflection device 200 so the retention elements and/or bristle tufts can be melted together to secure the bristle tufts in the retention elements. A transport system 300 also provides the ability to move the tooling plate 400 through the heat reflection device 200 at a continuous speed, resulting in even movement of the components through the heat reflection device. A continuous pace, rather than "stop and go" movement helps ensure more even application of heat to the various components being processed. However, other methods of sequential processing steps are possible, including the tooling plate 400 remaining in a fixed position, and the manufacturing equipment, including the heat reflection device 200, necessary to perform the various processing steps moving to the location of the tooling plate 400.

In one arrangement of the present invention, the mechanism 300 used to transport the tool plate 400 into the heat reflection device 200 can be operated at a variable speed, either automatically, or in response to data from sensors, so the processing of the components on the tool plate 400 can be optimized. For example, based on the ambient temperature in the heat reflection device 200 sensed by a thermometer, the transport system 300 could be sped up/slowed down, or paused prior to entering heat reflection device 200 so optimal melting of the retention element 52 and/or the bristle tufts 21 on the tool plate 400 is achieved. With the variation of the speed of the transport system 300, and the ability to adjust the temperature settings of the heat reflection device 200 by adjusting the emitted temperature or adjusting the distance between the tool plate or retention elements and the heating elements, the melting process can be optimized for improved consistent melting. Additionally, by containing the heat in the heat reflection device and reflecting heat to the work area, a more cost-effective manufacturing process may be achieved, reducing manufacturing utility costs.

Figure 8:
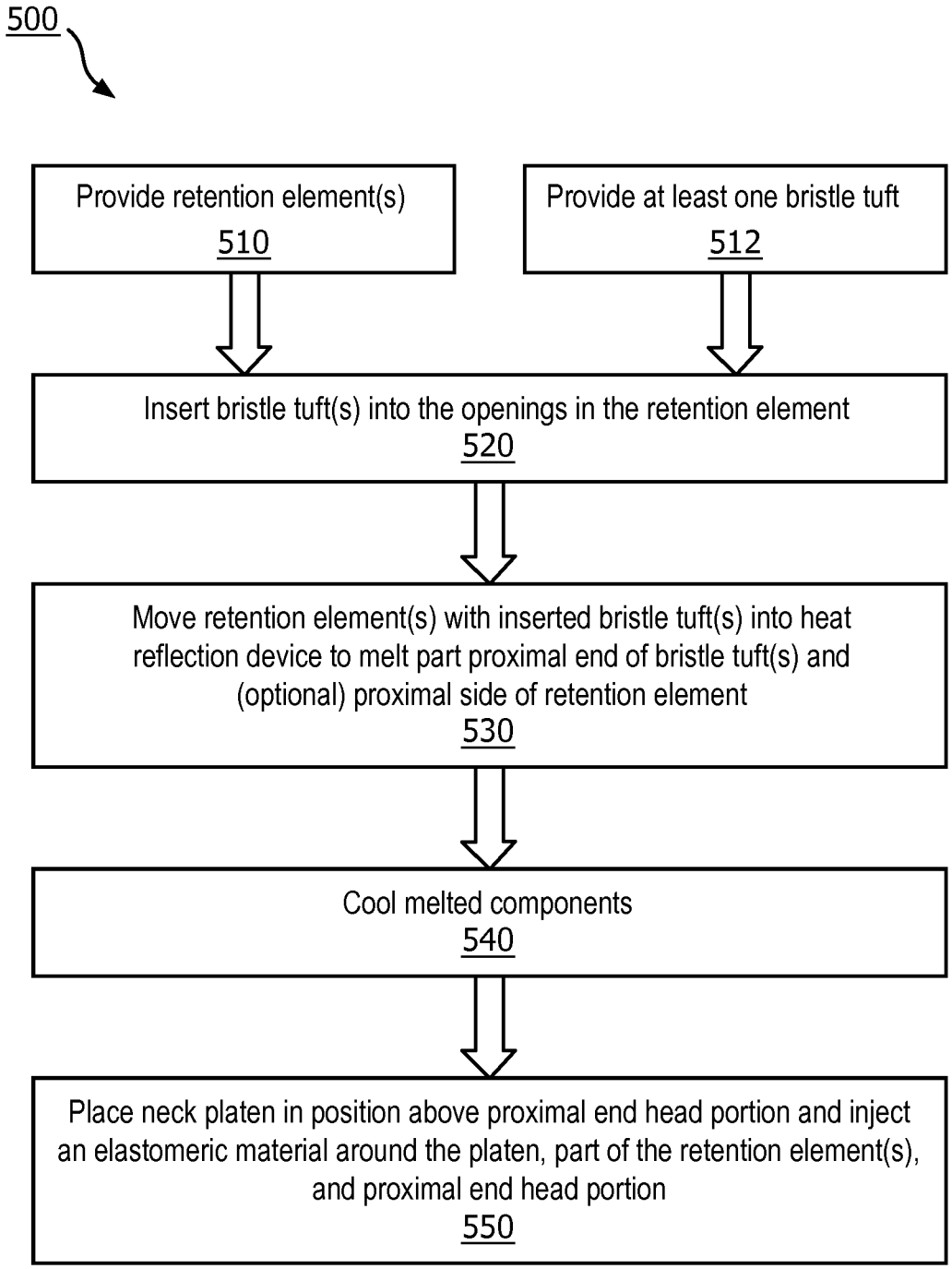
FIG. 8 is a flowchart of a method for manufacturing a brush head assembly with heating in a heat reflection device in accordance with an embodiment

FIG. 8 shows a method 500 for manufacturing one or more of the brush heads 10 described or otherwise envisioned herein. In step 510 of the method of manufacture depicted in FIG. 8, a tuft carrier 50 having at least one retention element 52 is provided, as shown in FIG. 2. In the cut-away side view schematic shown in FIG. 2, each of the at least one retention elements 52 includes at least one opening 51 therethrough. The tuft carrier 50 has a proximal side 53 and a distal side. In the embodiment depicted in FIG. 2, the retention element 52 has more than one opening 51.

At step 512 of the method, at least one bristle tufts 21, each of which comprises a plurality of bristle strands 22 is provided. The bristle tuft(s) 21 are shaped and sized to reflect the shape and size of the respective opening 51 in the retention elements 52 into which the bristle tuft 21 will be inserted.

At step 520 of the method, at least one bristle tuft 21 is inserted into the opening(s) 51 in the retention element(s) 52. As shown in FIG. 2, each of the bristle tufts 21 includes a proximal end 23 and a free end 25, with the proximal end 23 being contained in the retention element 52.

At step 530 of the method, tuft carrier 50 having the retention element(s) 52 containing the bristle tufts 21 is moved into a heat reflection device 200 to melt the components, which, when cooled, create a proximal end head portion 26. Depending on the materials used for the bristles 22 and the tuft carrier 50 and retention elements 52, as well as the heat applied in the heat reflection device 200, the proximal end head portion 26 may be created by melting the proximal end 23 of the bristle tufts 21; or the proximal end head portion 26 may be created by melting the proximal end 23 of the bristle tufts together with a portion of the proximal side 53 of the tuft carrier 50. In order for the retention elements 52 and bristle tufts 21 to melt together to form a merged unit, it has been found that they are preferably made from the same or a similar material, such as plastics (in particular ABS {Acrylonitrile Butadiene Styrene}plastics) or nylons (in particular PA {polyamide} nylon), a thermoplastic polymer such as polypropylene, or a similar material, or variations or combinations of these materials that have a similar co-efficient of melting so that they will melt and cool at a similar temperature and rate. However, it can be appreciated that other materials may be used, as long as they are subject to melting. When cooled, the proximal end 23 of the bristle tufts 21 and the proximal side 53 of the retention element 52 will bond or merge together to form a merged proximal end head portion 26. Alternatively, if the retention element 52 is made of a material with a higher co-efficient of melting than the material of the bristle tufts 21, the proximal end 23 of the bristle tufts will melt together and form the proximal end head portion 26, which will retain the bristle tuft in the retention element, but the retention element will not melt if the temperature in the heat reflection device 200 is kept below the melting temperature of the retention element 52.

The heat reflection device 200 has one or several heating elements 105 arranged in a line or other pattern, placed at an optimal distance from the surface(s) to be melted. The heat reflection device 200 also has at least a top wall that is made of or has heat reflective surfaces 210 on the inside thereof to reflect the heat from the heating element(s) toward the surface to be melted, so that a more uniform heat is applied to the components to be melted, and a more consistent melting is achieved. The heat reflection device 200 may also have side and/or bottom walls that may be made of or have heat reflective surfaces 210 on the inside thereof to further retain and reflect the heat toward the surface to be melted. The heat reflection device may also have at least one opening 220 through which the tuft carrier 50 having retention elements 52 containing the bristle tufts 21 may be inserted into the heat reflection device 200 for melting. The heat reflection device 200 may also have a different opening 220 on the opposite side thereof (not shown) through which the melted components may exit the heat reflection device 200. Additionally, in some arrangements of the present invention, the openings 220 can be further enclosed by door-like devices 230, which can be opened and closed to allow entry and exit of the retention elements and bristle tufts for the heating portion of the manufacturing process. These door-like devices 230 help to further retain heat within the heat reflection device 200. In some arrangements of the present invention, a transport system 300 moves the retention element(s) 52 and inserted bristle tufts 21 from step 520 into the heat reflection device 200 so that step 530 of the manufacturing process, melting of the bristle tuft proximal end 23, or melting of the bristle tuft proximal end 23 and proximal side 53 of the tuft carrier 50 having retention elements 52 can be performed in the heat reflection device 200.

After the proximal end head portion 26 has been formed, it is allowed to cool at step 540, which can take place in the heat reflection device 200, or outside the heat reflection device.

In step 550 of the method 500, the brush head neck 40 is positioned to put the platen 42 in the proper location in relation to the proximal end head portion 26 of the bristle tufts 21 and the retention element(s) 52. The platen 42 is positioned just above the proximal end head portions 26. Platen 42 can be properly positioned using a mold, for example, or other positioning mechanism. An elastomeric material is injected into the space between the platen 42, and around at least a portion of the proximal end head portion 26 and retention element(s) 52. The elastomeric material forms a molded elastomeric matrix 30, which encompasses at least a portion of the platen 42, the retention element 52, and proximal end head portion 26 to form a brush head assembly 10, as shown in FIG. 1A. According to an embodiment, elastomeric matrix 30 is preferably made from a flexible thermoplastic elastomer. Step 550 can be performed on the same or different manufacturing equipment and immediately after step 540 or at a later time.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A method for manufacturing a brush head, the method comprising the steps of:

inserting a plurality of bristle tufts into a tuft carrier, wherein a proximal end of each bristle tuft is inserted into a different opening of the tuft carrier;

activating a heat reflection device having at least one heating element and at least one heat reflecting surface therein, wherein the heat reflection device comprises multiple sides to at least partially contain the heat generated by the heating element, and an opening that can be used to insert or remove the entire tuft carrier with the inserted plurality of bristle tufts within the heat reflection device to be heated by the heating element;

placing the tuft carrier with the inserted plurality of bristle tufts into the heat reflection device;

directing heat from the at least one heating element toward the tuft carrier with the inserted plurality of bristle tufts to at least partially melt the proximal end of each of the plurality of bristle tufts each bristle tuft; and, cooling the melted proximal end head portion.

2. The method of claim 1 wherein the tuft carrier is positioned on a tooling plate prior to being placed into the heat reflection device.

3. The method of claim 1, further comprising at least one bristle tuft retention element, wherein the at least one bristle tuft retention element and bristle tufts are made of the same material or a similar material having a similar melting temperature such that the melting of the placing step partially melts and merges the proximal end of each of the plurality of bristle tufts and at least a portion of a proximal side of the at least one bristle tuft retention element together to create the proximal end head portion.

4. The method of claim 1 wherein the heating element or the at least one heat reflecting surface is at least partially adjustable in height and/or angle with respect to the tuft carrier within the heat reflection device.

5. The method of claim 1 wherein the heating element is a hot air heat source or an electrically driven helical heating element.

6. The method of claim 1 wherein the temperature of the heat generated by the heating element is controllable and adjustable.

7. The method of claim 1 wherein the heat reflection device further has at least one door that can be used in the opening that can be opened to insert or remove the tuft carrier in the heat reflection device to help further contain the heat generated by the heating element in the heat reflection device.

8. The method of claim 1 wherein the step of placing the tuft carrier within the heat reflection device is performed by a transport mechanism arranged to move the tuft carrier from outside the heat reflection device to inside the heat reflection device.

9. The method of claim 8 wherein the step of cooling the melted proximal end head portion is accomplished by moving the at least one tooling plate or tuft carrier from inside the heat reflection device to outside the heat reflection device.

10. A method for manufacturing a brush head, the method comprising the steps of:

inserting a plurality of bristle tufts into a tuft carrier, wherein a proximal end of each bristle tuft is inserted into a different opening of the tuft carrier;

activating a heat reflection device having at least one heating element and at least one heat reflecting surface therein, wherein the heat reflection device has: (i) at least one opening that can be used to insert the tuft carrier with the inserted plurality of bristle tufts into the heat reflection device; and (ii) at least one door that can be used in the at least one opening that can be opened to insert or remove the tuft carrier;

placing the tuft carrier with the inserted plurality of bristle tufts into the heat reflection device;

directing heat from the at least one heating element toward the tuft carrier with the inserted plurality of bristle tufts to at least partially melt the proximal end of each of the plurality of bristle tufts to create a proximal end head portion for each bristle tuft; and cooling the melted proximal end head portion.

* * * * *